US009664000B2

(12) United States Patent
Richards

(10) Patent No.: US 9,664,000 B2
(45) Date of Patent: May 30, 2017

(54) CONTINUOUSLY SEALING TELESCOPING JOINT HAVING MULTIPLE CONTROL LINES

(71) Applicant: HALLIBURTON ENERGY SERVICES, INC., Houston, TX (US)

(72) Inventor: William Mark Richards, Flower Mound, TX (US)

(73) Assignee: Halliburton Energy Services, Inc., Houtston, TX (US)

( * ) Notice: Subject to any disclaimer, the term of this patent is extended or adjusted under 35 U.S.C. 154(b) by 485 days.

(21) Appl. No.: 14/375,470

(22) PCT Filed: Jul. 8, 2013

(86) PCT No.: PCT/US2013/049549

§ 371 (c)(1),
(2) Date: Jul. 30, 2014

(87) PCT Pub. No.: WO2015/005897

PCT Pub. Date: Jan. 15, 2015

(65) Prior Publication Data

US 2016/0186525 A1 Jun. 30, 2016

(51) Int. Cl.
*E21B 17/07* (2006.01)

(52) U.S. Cl.
CPC ..... *E21B 17/07* (2013.01)

(58) Field of Classification Search
CPC ..... E21B 17/07
See application file for complete search history.

(56) References Cited

U.S. PATENT DOCUMENTS 3,718,183 A 2/1973 Scott
4,626,135 A 12/1986 Roche
(Continued)

FOREIGN PATENT DOCUMENTS

WO 2010104667 9/2010
WO 2013019407 2/2013
(Continued)

OTHER PUBLICATIONS

International Patent Application No. PCT/US2013/049549, "International Search Report and Written Opinion", mailed Apr. 9, 2014, 13 pages.

*Primary Examiner* — Robert E Fuller
*Assistant Examiner* — Steven MacDonald
(74) *Attorney, Agent, or Firm* — Kilpatrick Townsend & Stockton LLP

(57) ABSTRACT

A telescoping joint is provided with one or more control lines and is usable for landing a subsea tubing hanger. The telescoping joint can include an inner mandrel, an outer mandrel, a seal between the inner mandrel and the outer mandrel, and a coiling chamber. The outer mandrel is controllably releasable from the inner mandrel by a release mechanism. The seal is sealably engaged with the outer mandrel for continuously sealing an inner area defined by the inner mandrel from a wellbore environment exterior to the telescoping joint as the outer mandrel axially moves relative to the inner mandrel. A control line is coiled in the coiling chamber and the coiling chamber is axially positioned between the release mechanism and the seal.

19 Claims, 4 Drawing Sheets

(56) References Cited

U.S. PATENT DOCUMENTS

| | | | | |
|---|---|---|---|---|
| 5,048,610 | A * | 9/1991 | Ross | E21B 33/122 166/117.5 |
| 5,113,939 | A * | 5/1992 | Ross | E21B 33/122 166/120 |
| 5,727,630 | A | 3/1998 | Brammer | |
| 6,349,770 | B1 | 2/2002 | Brooks et al. | |
| 6,367,552 | B1 | 4/2002 | Scott et al. | |
| 6,540,025 | B2 | 4/2003 | Scott et al. | |
| 6,983,796 | B2 | 1/2006 | Bayne et al. | |
| 7,730,957 | B2 * | 6/2010 | Blanton | E21B 17/028 166/242.2 |
| 2004/0168794 | A1 | 9/2004 | Vold | |
| 2005/0072564 | A1 | 4/2005 | Grigsby et al. | |
| 2008/0053652 | A1 * | 3/2008 | Corre | E21B 33/1243 166/179 |
| 2009/0032268 | A1 * | 2/2009 | Blanton | E21B 17/07 166/386 |
| 2010/0101778 | A1 | 4/2010 | Lembcke | |
| 2010/0300698 | A1 * | 12/2010 | Bedouet | E21B 17/07 166/355 |
| 2011/0209651 | A1 | 9/2011 | Yemington | |
| 2013/0025880 | A1 | 1/2013 | Richards et al. | |
| 2014/0124217 | A1 | 5/2014 | Godager et al. | |
| 2015/0129240 | A1 | 5/2015 | Bishop et al. | |
| 2015/0330157 | A1 | 11/2015 | Roane et al. | |

FOREIGN PATENT DOCUMENTS

| | | |
|---|---|---|
| WO | 2014051565 | 4/2014 |
| WO | 2014051566 | 4/2014 |
| WO | 2014051568 | 4/2014 |
| WO | 2014130032 | 8/2014 |
| WO | 2014193419 | 12/2014 |
| WO | 2014193420 | 12/2014 |
| WO | 2015005895 | 1/2015 |

* cited by examiner

CONTINUOUSLY SEALING TELESCOPING JOINT HAVING MULTIPLE CONTROL LINES

CROSS-REFERENCE TO RELATED APPLICATIONS

This is a U.S. national phase under 35 U.S.C. 371 of International Patent Application No. PCT/US2013/049549, titled "Continuously Sealing Telescoping Joint Having Multiple Control Lines" and filed Jul. 8, 2013, the entirety of which is incorporated herein by reference.

TECHNICAL FIELD

The present disclosure relates generally to a telescoping joint to be located in a wellbore and, more particularly (although not necessarily exclusively), to a telescoping joint that seals continuously and has multiple control lines.

BACKGROUND

Drilling rigs supported by floating drill ships or floating platforms can be used for offshore wellbore creation and production. A telescoping joint (also referred to as a travel joint) in tubing can be used in running a tubing hanger in a wellhead for offshore production. After the tubing is set in a packer assembly downhole, the telescoping joint can be released to shorten from an extended position and allow the tubing hanger to be set in the wellhead.

Control lines can be coupled external to production tubing to provide a path for power, communication, and other purposes between surface instruments and flow control devices, gauges, and other components in the wellbore. Axial movements of the telescoping joint can impart stress on control lines. Axial movement, or stroking, distance of the telescoping joint may be limited in part because of the control lines. Furthermore, exposure of an area internal to the telescoping joint to external pressure is undesirable.

DETAILED DESCRIPTION

Certain aspects and features relate to a continuously sealing telescoping joint with one or more control lines and that is usable for landing a subsea tubing hanger. In some aspects, the telescoping joint is a Long Space-Out Travel Joint.

The telescoping joint can include an inner mandrel, an outer mandrel, and coiled control lines to allow for telescoping of the outer mandrel and inner mandrel. Up to two sets of three control lines can be coiled one on top of another on an outer surface of the inner mandrel.

The telescoping joint can also include one or more seals at an upper portion of the inner mandrel. The outer mandrel can include a hone bore having a sealing finish along an inner surface of the hone bore. The seals can cooperate with the inner surface of the hone bore to seal an inner area defined by the inner mandrel from an environment exterior to the outer mandrel. The telescoping joint can include a release mechanism that is controllable by compression release or control line release to release the outer mandrel from the inner mandrel and allow telescoping. The hone bore may be relative long and continuous. The seals can cooperate with the inner surface of the hone bore continuously as the outer mandrel strokes and moves downward relative to the inner mandrel so that a tubing hanger can be landed on a wellhead after the outer mandrel is released.

An inner control line can be wound clockwise and another control line can be wound counter-clockwise to prevent interference or nesting during expansion and contraction when telescoping. Examples of control lines include a hydraulic control line, a fiber optic control line, an electrical control line, and a hybrid control line. Control lines can provide power, control, and/or data communication to completion components in the wellbore below the telescoping joint, or otherwise positioned in the wellbore such that the telescoping joint is between the components and a wellhead.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
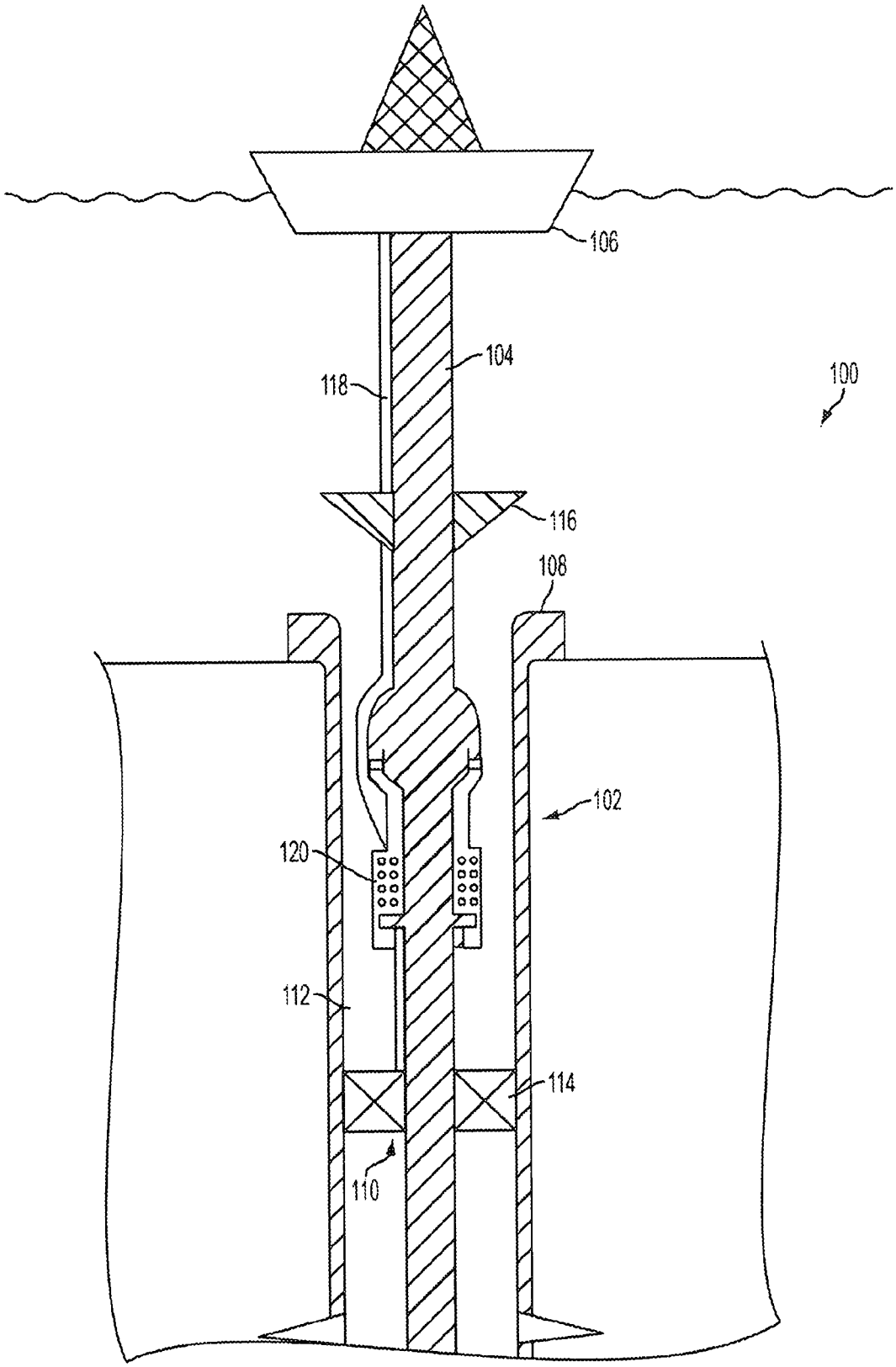
FIG. 1 is a cross-sectional view of a subsea well system with a telescoping joint according to one aspect.

FIG. 1 depicts a subsea well system 100 with a telescoping joint 102 according to one aspect. The subsea well system 100 includes a tubular string 104 that includes the telescoping joint 102. The tubular string 104 extends downwardly from a drilling rig 106. The drilling rig 106 may be a floating platform, drill ship, or jack up rig. In some aspects, the tubular string 104 may be inside a riser between the drilling rig 106 and a wellhead 108.

The tubular string 104 can be stabbed into a completion assembly 110 that has been installed in a wellbore 112. The tubular string 104 can be sealingly received in a packer 114 at an upper end of the completion assembly 110. In some aspects, the tubular string 104 can have a seal stack that seals within a sealed bore receptacle. The tubular string 104 may also have flow control devices, valves, or other components that can control or regulate the flow of reservoir fluids into the tubing string 104. Control lines, such as control lines 118 in FIG. 1, can provide power, communication, or both to the components so that the components can be positioned from the surface, for example. The tubular string 104 can be connected with the completion assembly 110 using any suitable means.

The completion assembly 110 can be used in a completion process for at least a portion of the wellbore 112 that prepares the wellbore 112 for production or injection operations. The completion assembly 110 can include one or more elements that facilitate production or injection operations. Examples of elements that can be in the completion assembly 110 include packers, well screens, perforated liner or casing, production or injection valves, flow control devices, and chokes.

The telescoping joint 102 can be used to shorten the tubular string 104 axially between the completion assembly 110 and the wellhead 108. After the tubular string 104 has been connected to the completion assembly 110, the telescoping joint 102 can be released to allow a tubing hanger 116 on the tubular string 104 to be landed in the wellhead 108. For example, the bottom portion of the tubular string 104 can be fixed and the top portion of the tubular string 104, including the telescoping joint 102 can stroke downward until the tubing hanger 116 lands on the wellhead 108.

The telescoping joint 102 can be released by any suitable release mechanism. In some aspect, the telescoping joint 102 includes a hydraulic release device that can release the telescoping joint 102 in response to a predetermined compressive force applied to the tubular string 104 for a predetermined amount of time. The telescoping joint 102 may also have a resetting feature that permits the telescoping joint 102 to be locked back after having been compressed. An example of a release mechanism is described in U.S. Pat. No. 6,367,552. Other examples of release mechanisms include j-slots and control signals delivered by a control line.

One or more control lines 118 extend from the drilling rig 106 external to the tubular string 104 to the telescoping joint 102. At the telescoping joint 102, the control lines 118 can be received through a port and coiled 120 around an inner mandrel of the telescoping joint 102. The control lines 118 extend from the telescoping joint 102 to the completion assembly 110. The control lines 118 can provide power or data communication and control between a surface and elements of the completion assembly 110, elements on the tubular string 104, or otherwise other components in the wellbore 112.

The telescoping joint 102 allows some variation in the length of the tubular string 104 between the tubing hanger 116 and the completion assembly 110 by, for example, allowing the length of the tubular string 104 to shorten after the completion assembly 110 has been sealingly engaged so that the tubing hanger 116 can be appropriately landed in the wellhead 108. The control lines 118 can be coiled 120 to allow the telescoping joint 102 to stroke, such as by shortening the tubular string 104, without damaging the integrity of the control lines 118. Certain aspects of the telescoping joint 102 allow for a longer stroke without damaging the control lines 118 to account for variables such as a corkscrewing tubular, deviated wellbore, and drilling rig 106 changing position longitudinally and laterally due to currents and other forces. For example, the telescoping joint 102 can have a stroke distance that is greater than a potential distance between the tubing hanger 116 and the wellhead 108. Using a telescoping joint 102 according to certain aspects can continuously pressure seal an inner area defined by the inner mandrel while also allowing one or more control lines to traverse from one end of the telescoping joint to another end.

Figure 2:
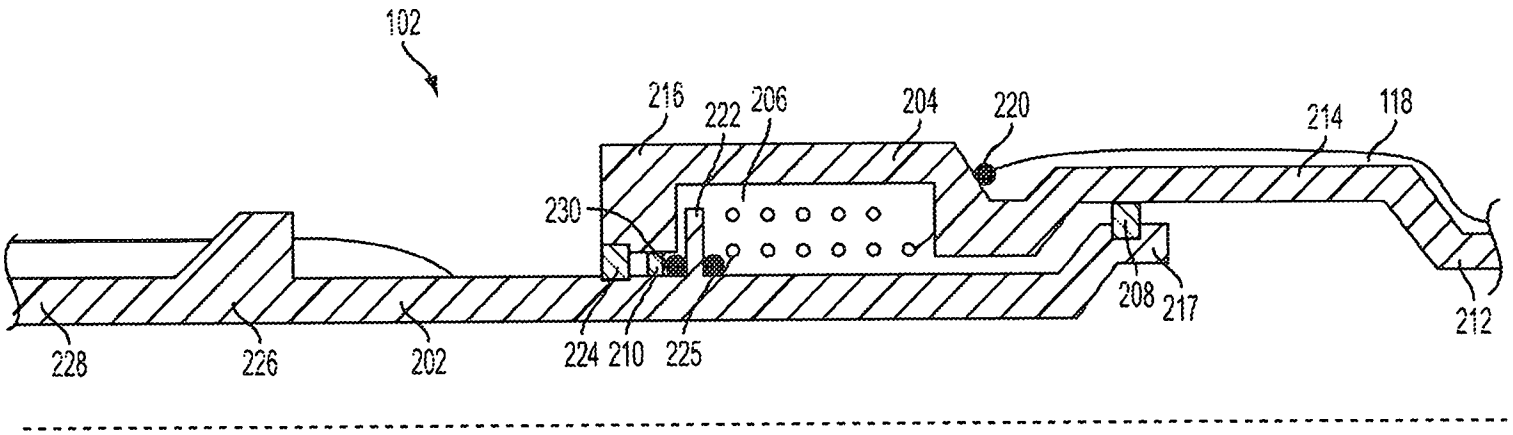
FIG. 2 is a cross-sectional side view of part of a telescoping joint according to one aspect.

FIG. 2 depicts by cross-sectional side view part of the telescoping joint 102. The telescoping joint 102 includes an inner mandrel 202 and outer mandrel 204. The inner mandrel 202 and the outer mandrel 204 define a coiling chamber 206. The telescoping joint 102 also includes a seal 208 and a release mechanism 210. The seal 208 may be coupled to the inner mandrel 202 and be positioned between the coiling chamber 206 and a surface of the wellbore. The coiling chamber 206 can be between the seal 208 and the release mechanism 210.

The outer mandrel 204 includes an adaptor 212, a hone bore 214, and an outer housing 216. The adaptor 212 can couple the outer mandrel 204 to a tubular string, such as part of the tubular string 104 between the telescoping joint 102 and the tubing hanger 116 in FIG. 1. The outer housing 216 can define the coiling chamber 206.

The hone bore 214 can cooperate with the seal 208 to pressure seal an inner area defined by the inner mandrel 202 continuously when the telescoping joint is run into the wellbore and when the outer mandrel 204 is stroking with respect to the inner mandrel 202. For example, the hone bore 214 can cooperate with the seal 208 after the outer mandrel 204 is released from the inner mandrel 202 by the release mechanism 210 and the outer mandrel 204 moves relative to the inner mandrel 202. In some aspects, the hone bore is 30 feet to 35 feet long and provides a stroking distance for the telescoping joint 102 of up to 30 feet to 35 feet. The inner mandrel 202 includes a guide 217 to which the seal 208 is coupled.

Control lines 118 extend external to the adaptor 212 and the hone bore 214 of the outer mandrel 204. The control lines 118 also traverse through a pressure fitting 220 in the outer mandrel 204 to the coiling chamber 206. Control lines 118 coiled in the coiling chamber 206 can be coupled to, or otherwise contact, a lower bushing 222 of the inner mandrel 202. The lower bushing 222 can extend into the coiling chamber 206.

One or more control lines 118 can be used. In some aspects, the number of control lines 118 is six. The first set of control lines (e.g., 3 control lines) can be wound clockwise around an outer surface of inner mandrel 202 and the second set of control lines (e.g., 3 additional control lines) can be wound counter-clockwise around an outer surface of the inner mandrel 202.

The control lines 118 can pass under the release mechanism 210 and a spline 224 through a second pressure fitting 225 with a drilled port, along with grooves (not shown in FIG. 2) in the inner mandrel 202. The spline 224 can be received in a slot (not shown in FIG. 2) in the inner mandrel 202 to prevent the inner mandrel 202 from rotating with respect to the outer mandrel 204.

Figure 3:
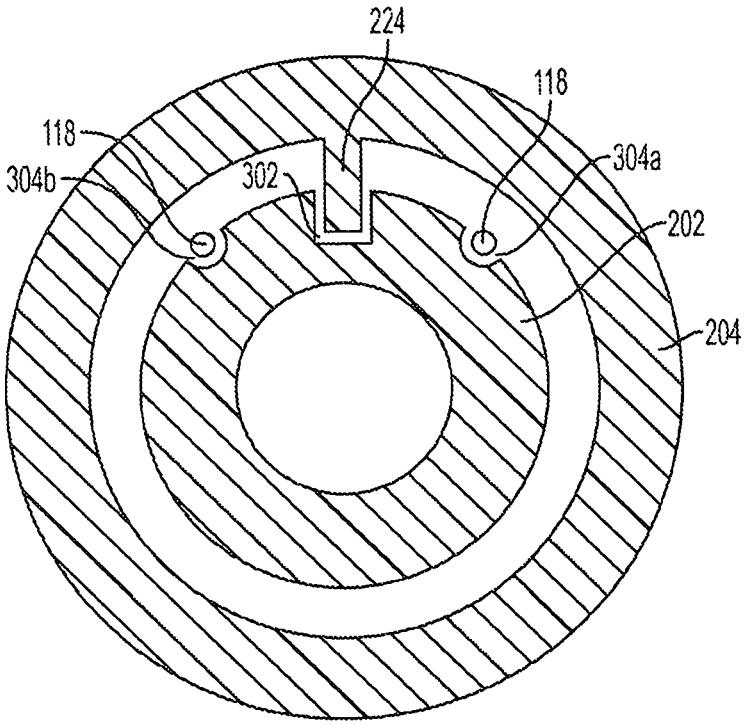
FIG. 3 is a cross-sectional view of an inner mandrel and an outer mandrel of the telescoping joint of FIG. 2 according to one aspect.

FIG. 3 depicts a cross-section of the inner mandrel 202 including a slot 302 receiving the spline 224 according to one aspect. The spline 224 in FIG. 3 is part of the outer mandrel 204. In other aspects, the spline 224 is separate, but coupled to, the outer mandrel 204. Also depicted in FIG. 3 are control lines 118 received in grooves 304*a-b* in the inner mandrel 202. In some aspects, each of the grooves 304*a-b* can receive one of the control lines 118. The grooves 304*a-b* can allow the control lines 118 to bypass the spline 224 and the release mechanism 210 of FIG. 2, such as by traversing internally of the telescoping joint 102 and past the release mechanism 210.

Returning to FIG. 2, the control lines 118 can exit the inner mandrel 202 below the spline 224. The control lines 118 can traverse through a slot in a lower subassembly 226 and extend along an exterior of lower tubing 228 between the lower subassembly 226 and completion components in the wellbore.

In some aspects, the telescoping joint 102 includes an additional seal 230 between the release mechanism 210 and the lower bushing 222. In other aspects, the additional seal 230 is not included.

Figure 4:
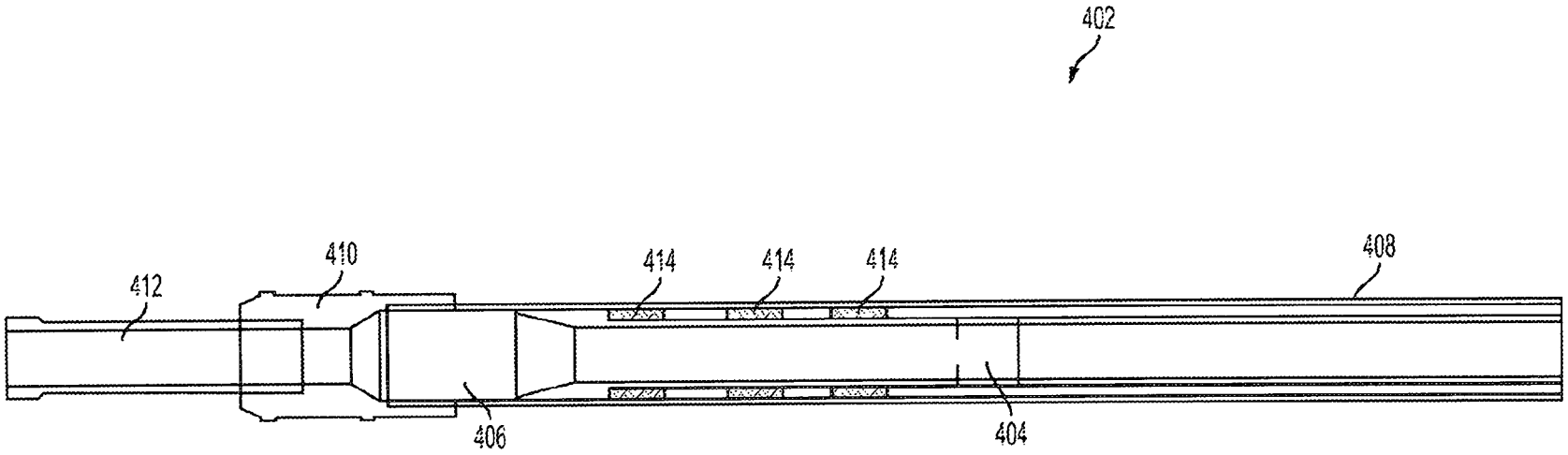
FIG. 4 is a cross-sectional side view of a telescoping joint with a set of seals according to one aspect.

A telescoping joint according to other aspects may include additional seals that cooperate with a hone bore for providing a pressure seal for an inner area defined by an inner mandrel. FIG. 4 is a cross-sectional side view of a telescoping joint 402 according to one aspect. The telescoping joint includes an inner mandrel 404 and an outer mandrel 406. The outer mandrel 406 includes a hone bore 408 and an adaptor 410 coupling the outer mandrel 406 to a tubular 412. Included around part of the inner mandrel 404 is a set of seals 414. The set of seals 414 in FIG. 4 includes 3 seals, but any number of seals can be used. The set of seals 414 can cooperate with the hone bore 408 as the outer mandrel 406 strokes or otherwise moves relative to the inner mandrel 404 to pressure seal an inner area 416 defined by the inner mandrel 404 from an environment exterior to the outer mandrel 406.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A telescoping joint comprising:

an inner mandrel;

an outer mandrel controllably releasable from the inner mandrel by a release mechanism;

a seal between the inner mandrel and the outer mandrel and sealably engaged with the outer mandrel for continuously sealing an inner area defined by the inner mandrel from a wellbore environment exterior to the telescoping joint as the outer mandrel axially moves relative to the inner mandrel; and a coiling chamber in which a control line is coiled and that is axially positioned between the release mechanism and the seal, wherein the seal is axially located between a wellhead and the coiling chamber.

2. The telescoping joint of claim 1, wherein the inner mandrel includes a groove receiving the control line and allowing the control line to traverse internally of the telescoping joint to the release mechanism.

3. The telescoping joint of claim 2, wherein the inner mandrel includes a slot receiving a spline and preventing the inner mandrel from rotating with respect to the outer mandrel, wherein the groove allows the control line to bypass the spline.

4. The telescoping joint of claim 3, wherein the outer mandrel includes the spline.

5. The telescoping joint of claim 1, wherein the seal includes a set of seals.

6. The telescoping joint of claim 1, wherein the control line includes multiple control lines between an upper portion of the telescoping joint and a lower portion of the telescoping joint, the upper portion being closer to the wellhead of a wellbore than the lower portion.

7. The telescoping joint of claim 6, wherein the outer mandrel includes a pressure fitting through which the multiple control lines traverse to the coiling chamber from an area external to the outer mandrel.

8. The telescoping joint of claim 1, wherein the inner mandrel includes a lower bushing extending into the coiling chamber.

9. The telescoping joint of claim 8, further comprising an additional seal between the release mechanism and the lower bushing.

10. The telescoping joint of claim 1, wherein the outer mandrel includes a hone bore that cooperates with the seal to pressure seal the inner area defined by the inner mandrel as the outer mandrel moves axially relative to the inner mandrel.

11. A wellbore tubular, comprising:

an upper tubular portion between a tubing hanger and a telescoping joint;

a lower tubular portion between the telescoping joint and a completion component in a wellbore; and the telescoping joint that includes a coiling chamber with coiled control lines and that is axially located between a release mechanism and a seal that continuously pressure seals an inner area defined by the telescoping joint and an environment of the wellbore external to the telescoping joint as the telescoping joint strokes in the wellbore, wherein the seal is axially located between a wellhead and the coiling chamber.

12. The wellbore tubular of claim 11, wherein the telescoping joint includes an inner mandrel and an outer mandrel that is controllably releasable from the inner mandrel by the release mechanism, wherein the seal is sealably engaged with the outer mandrel for continuously pressure sealing the inner area as the outer mandrel axially moves relative to the inner mandrel.

13. The wellbore tubular of claim 12, wherein the inner mandrel includes a slot receiving a spline and preventing the inner mandrel from rotating with respect to the outer mandrel.

14. The wellbore tubular of claim 12, wherein the outer mandrel includes a hone bore that cooperates with the seal to pressure seal the inner area as the outer mandrel moves axially relative to the inner mandrel.

15. The wellbore tubular of claim 14, wherein the seal includes a set of seals.

16. The wellbore tubular of claim 12, wherein the inner mandrel includes a lower bushing extending into the coiling chamber.

17. The wellbore tubular of claim 16, wherein the telescoping joint includes an additional seal between the release mechanism and the lower bushing.

18. The wellbore tubular of claim 11, wherein the control lines extend from the tubing hanger to the completion component.

19. The wellbore tubular of claim 11, wherein the telescoping joint includes grooves receiving the control lines and allowing the control lines to traverse internally to the release mechanism.

* * * * *